US005595455A

United States Patent [19]

Svirklys

[11] Patent Number: 5,595,455

[45] Date of Patent: Jan. 21, 1997

[54] TRANSITION COLLAR

[75] Inventor: Ferdinand M. Svirklys, Rexdale, Canada

[73] Assignee: Domal Envirotech Inc., Rexdale, Canada

[21] Appl. No.: 352,614

[22] Filed: Dec. 9, 1994

Related U.S. Application Data

[63] Continuation-in-part of PCT/CA92/00509, Nov. 16, 1992.

[51] Int. Cl.[6] ..... E02D 29/14

[52] U.S. Cl. ..... 404/25; 404/26; 52/20; 52/21

[58] Field of Search ..... 404/25, 26; 52/19, 52/20, 21

[56] References Cited

U.S. PATENT DOCUMENTS

| | | | |
|---|---|---|---|
| 3,263,580 | 8/1966 | MacMillan | 94/34 |
| 4,158,515 | 6/1979 | Helms | 404/72 |
| 4,759,656 | 7/1988 | Wilson | 404/26 |
| 4,808,025 | 2/1989 | McGinnis | 404/26 |
| 4,925,336 | 5/1990 | Simmonds | 404/25 |
| 4,927,290 | 5/1990 | Bowman | 404/26 |
| 4,969,771 | 11/1990 | Bowman | 404/26 |
| 5,030,030 | 7/1991 | Simmonds | 404/25 |
| 5,044,818 | 9/1991 | Pritchard | 404/26 |
| 5,362,175 | 11/1994 | Bectin | 404/26 |

FOREIGN PATENT DOCUMENTS

| | | |
|---|---|---|
| 2303122 | 10/1976 | France . |
| 3505300 | 8/1986 | Germany . |

*Primary Examiner*—Dennis L. Taylor
*Assistant Examiner*—Pamela A. O'Connor
*Attorney, Agent, or Firm*—Sim & McBurney

[57] ABSTRACT

A resilient annular transition collar is provided for roadway structures, including manholes and catch basins, which acts as a flexible transition between the rigid structure or frame of the manhole and the semi-rigid structure of the asphalt paving. The resilient transition collar absorbs any movement of the pavement during expansion and contraction and this absorption avoids the prior art problems of break-up, cracking and separation between manhole and pavement. Risers or adjusting rings may be employed in conjunction with the transition collar to ensure a flush fit between the pavement surface and the upper surface of the transition collar. A mold structure for forming the collars includes heat transfer studs to provide an increased production rate.

15 Claims, 4 Drawing Sheets

TRANSITION COLLAR

This is a continuation-in-part of PCT/CA92/00509, filed Nov. 16, 1992.

FIELD OF INVENTION

The present invention relates to a novel structure which functions as a transition collar for catch basins and manholes.

BACKGROUND TO THE INVENTION

At the present time, asphalt paving material generally surrounds manholes and catch basins. However, optimum compaction of the asphalt adjacent the periphery of the manhole or catch basin leads to deterioration of the asphalt in use. Expansion and contraction of the pavement occurs with varying temperature and leads to asphalt break-up, cracking and separation between pavement and manhole. Repairs typically are required at least every two to three years.

A search of the prior art conducted in the U.S. Patent and Trademark Office has located the following U.S. patents as the most relevant prior art:

| | |
|---|---|
| 3,263,580 | 4,808,025 |
| 4,927,290 | 5,030,030 |
| 4,759,656 | 4,925,336 |
| 4,969,771 | FR2303122 |

With respect to the prior art, U.S. Pat. Nos. 5,030,030 and 4,925,336 contain the same disclosure. These references describe a pad which supports a utility access conduit in a roadway. The support pad comprises a rectangular block of rubber or similar compressibly resilient elastomeric material which has an opening through it to snugly engage the access conduit.

U.S. Pat. No. 3,263,580 discloses a safety cover for a manhole which overlies the manhole cover, sits flush with a roadway and is fastened to the manhole cover by bolts. The cover also surrounds the upper portion of the manhole structure at the periphery.

French Patent No. 2,030,122 describes a procedure for fixing the frame of a manhole cover in place. A ring-shaped rebate is formed surrounding the frame and a sealant comprising a hardenable resin material is passed into the rebate and hardened to provide the final structure.

It will be apparent from the discussion below that none of this prior art discloses or suggests the structures which are described herein.

SUMMARY OF INVENTION

In accordance with the present invention, there is provided a novel structure which is intended to overcome these prior art problems. The present invention provides a resilient annular collar for the manhole or catch basin, which acts as a flexible transition between the rigid structure or frame of the manhole and the semi-rigid structure of the asphalt paving. The present invention also provides an improved mold structure for the provision of such collars.

Accordingly, in one aspect, the present invention provides a roadway structure comprising a subterranean access opening in said roadway, a self-supporting rigid frame structure surrounding said opening, a roadway pavement structure having a depression therein surrounding said subterranean opening and wherein is located said self-supporting rigid frame structure, and a resilient transition collar structure received in said depression and surrounding said rigid frame structure and spacing the distance from said rigid frame structure to said roadway pavement structure, said roadway depression being dimensioned and said resilient collar structure being arranged such that the upper surface of the transition collar structure lies in substantially planar alignment with the upper surface of said roadway pavement structure.

In another aspect of the present invention, there is provided for use in a roadway construction, the combination of (a) an annular resiliently-flexible transition collar having a central opening formed therethrough for receiving a self-supporting rigid frame structure of a roadway subterranean access opening therein, and (b) a set of riser rings for adjusting the height and/or orientation of said transition collar in a roadway depression adjacent the subterranean access. The present invention also includes riser rings for this purpose.

A further aspect of the invention provides an injection mold for molding a resilient transition collar from rubber scrap from automobile tires, comprising a mold cavity corresponding in shape to that of the collar into which rubber scrap is introduced to effect such molding, and defined by upper and lower mold-forming elements, one of said upper and lower mold-forming elements having heat-transfer studs protruding therefrom into the mold cavity.

GENERAL DESCRIPTION OF INVENTION

The resilient transition collar provided herein absorbs any movement of the pavement during expansion and contraction and this absorption avoids the prior art problems of break-up, cracking and separation between manhole and pavement. The resilient transition collar also absorbs shock and traffic vibration damage to the road surface and to the maintenance opening (manhole) and catch basin substructure as well as minimizing damage due to earth tremors or soil movements.

The resilient collar, which usually is formed of rubber material or other resilient material, which may be cured recycled scrap from automobile tires, has a relatively long life expectancy, such as twenty years or more, so that, once installed, the resilient collar avoids the necessity for the frequent repairs currently required.

The resilient collar permits better compaction of the asphalt adjacent the manhole or catch basin during paving operation as well as a simplified paving operation. Poor compaction of asphalt is often the reason for deterioration of the asphalt in the region of the manhole or catch basin. In addition, repair or replacement of the resilient collar is quicker and less labour intensive than the prior art.

The rigid frame of the manhole or catch basin, which generally supports a closure or cover, generally is round but may take other geometric shapes, such as square. The resilient collar has a central opening which is shaped to correspond to the shape of the cover, so as to snugly fit against the periphery of the frame structure. Generally, the collar has a thickness corresponding to the depth of the cover.

Minor adjustments with respect to differences in depth and orientation of the opening into which the transition collar is inserted and the pavement surface may be effected to ensure a flush fit between the pavement surface and the upper surface of the transition collar.

These adjustments may be effected by using risers or adjusting rings, also formed of resilient elastomeric material, such as scrap rubber, positioned below the transition collar in the roadway opening. The adjusting rings are annular and may be of the same external dimensions as the transition collar and have a central opening which does not interfere with sealing of the frame in the roadway opening.

Figure 7:
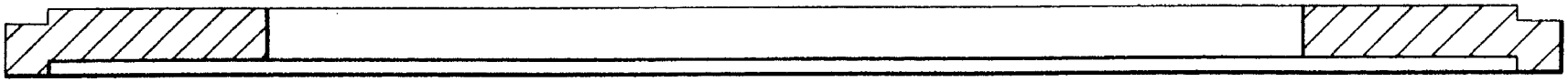
FIGS. 7, 8 and 9 are sectional views of three different riser elements used in conjunction with the resilient annular collar.
Figure 8:
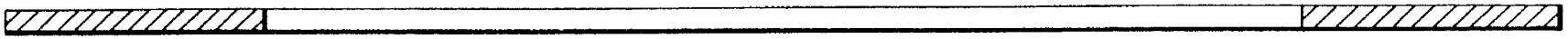
Figure 9:
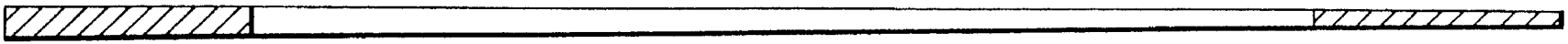

The risers or adjusting rings preferably comprise a set of three such rings, two having a uniform thickness but which differs one from the other, for example, three inches and two inches thickness. Sectional views of a set of such riser rings are shown in FIGS. 7, 8 and 9. The third riser has a wedge shape in side elevation view, varying uniformly from a first thickness dimension at one side to a second thickness dimension at the other, for example, 0.25 inch at one side and 0.5 inch at the other side. Members of the set and multiples thereof may be employed to provide for the correct height adjustment.

The uniform thickness risers permit adjustments to be made to compensate for variations in depth of the roadway opening while the non-uniform thickness risers permits adjustments to be made to compensate for a sloping bottom surface of the roadway opening. The risers may be combined, as necessary, in a particular manhole or catch basin situation.

The risers may be formed by compression molding of scrap rubber or other elastomeric material so as to be resiliently flexible, as described below to the desired combination of properties.

The resilient collar as well as the risers may have any convenient peripheral outline. Preferably, the collar has a circular outline to provide for an even distribution of forces applied to the transition collar in use, but any other convenient shape may be employed, such as square, particularly when employed with square or rectangular catch basin openings.

The novel road structure provided herein, comprising a manhole or catch basin, and resilient collar surrounding the manhole or catch basin and spacing a gap to the asphalt pavement, constitutes a considerable improvement over the prior art, having regard to the advantages thereof. Considerable long term economies can be realized employing the resilient collar arrangement of this invention.

The rigid frame of the manhole or catch basin may be permanently embedded in the collar, such as by molding the collar about the rigid frame, which often is formed of cast iron, before positioning the transition collar-rigid frame unit in the roadway or other location of the maintenance opening or catch basin, with or without riser rings. This arrangement ensures a secure bond between the transition collar and the rigid frame.

The manufacturing mold used for such molding operations may be designed to accommodate a variety of different size and configuration of frames while maintaining the same external dimension of transition collar.

The compression molding operation forming the transition collar preferably effects compression molding of rubber from scrap automobile tires or other scrap rubber material, together with the frame, to a desired density, modulus of elasticity, thermal expansion and hardness for the molded collar.

By employing scrap rubber material in the manufacture of the transition collar and risers, recycle of such waste material into a useful product is achieved. The transition collar and risers do not generate waste, since damaged or discarded collars and risers can themselves be recycled and fully used in the production of new collars and risers.

DESCRIPTION OF PREFERRED EMBODIMENT

Figure 1:
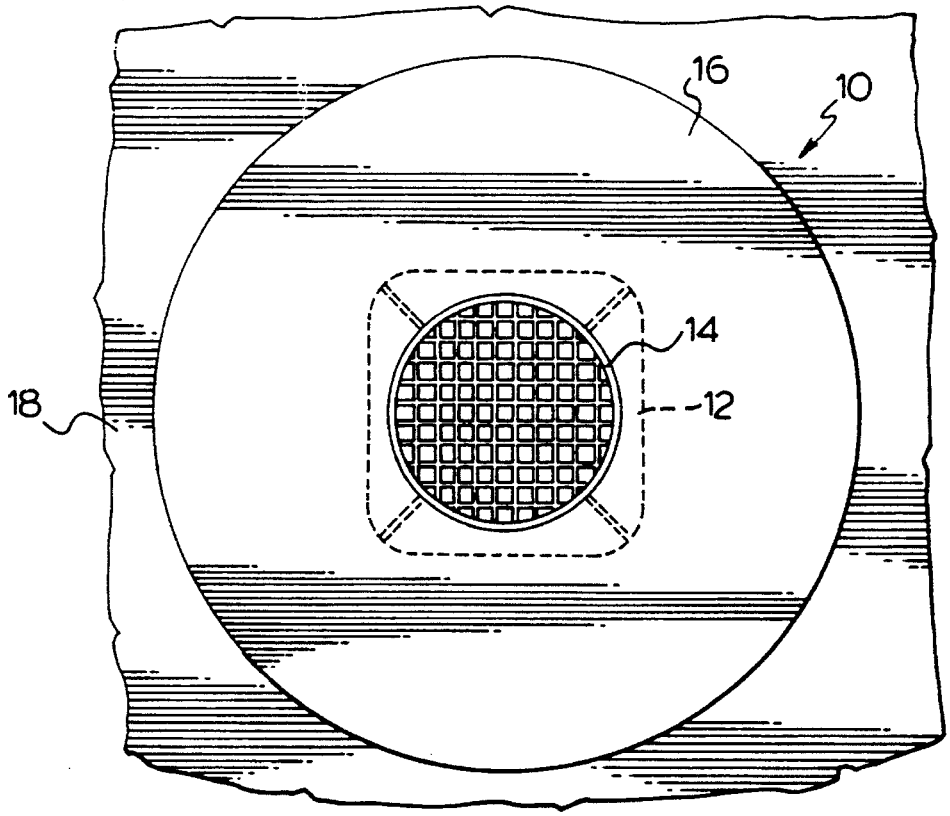
FIG. 1 is a plan view of a road structure incorporating a novel resilient collar constructed in accordance with one embodiment of the invention.
Figure 2:
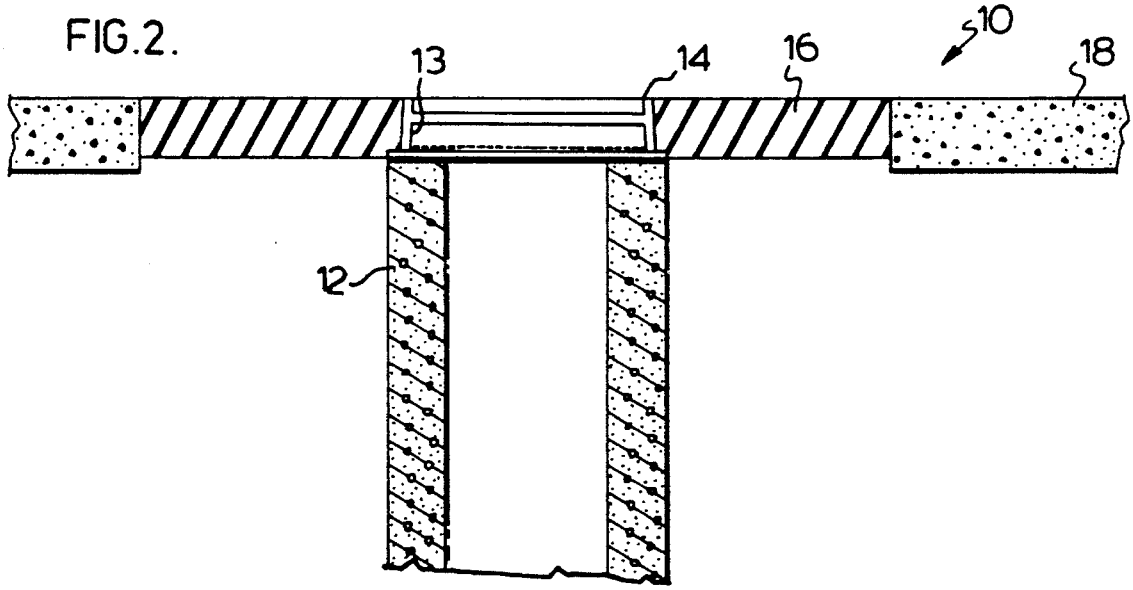
FIG. 2 is a side elevational sectional view of the road structure of FIG. 1.

Referring first to FIGS. 1 and 2 of the drawings, a road structure 10 comprises a catch basin or manhole structure 12, a cast iron frame 13 and cover or access hatch 14 for the catch basin or manhole structure 12 and having a circular periphery, a resiliently flexible rubber transition collar 16 surrounding the frame 13 and in engagement with the outer periphery thereof, and an asphalt pavement 18 surrounding and in engagement with the outer periphery of the collar 16.

The transition collar 16 sits flush with the asphalt pavement 18 in a generally circular opening therein. To compensate for variations in the depth and orientation of the subsurface on which the transition collar 16 sits, risers of the type described above may be employed (see FIGS. 5 and 6).

Figure 5:
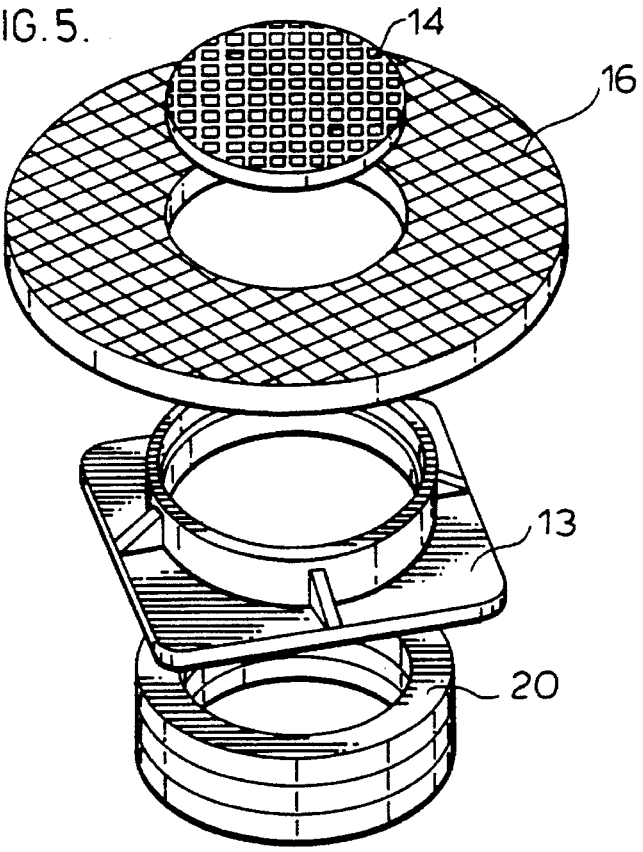
FIG. 5 is an exploded perspective view of the road structure shown in FIGS. 1 and 2 illustrating the relationship of the frame, transition collar and riser elements.

As seen in FIG. 5, one or more riser rings 20 may be positioned on the roadway depression and support the cast iron frame 13, providing such height adjustment as may be required to provide the transition collar flush with the asphalt pavement 18.

Figure 6:
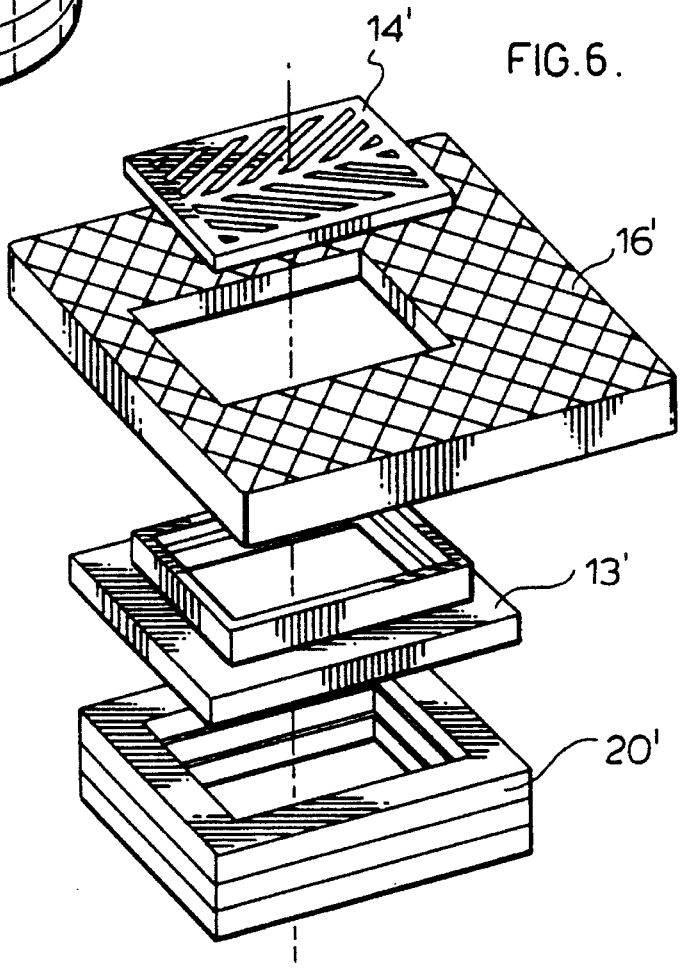
FIG. 6 is an exploded perspective view of an alternative form of roadway access device incorporating the present invention.

FIG. 6 shows an alternative form of transition collar 16', in this embodiment, in square outline for use with a rectangular catch basin cover or access hatch 14'. The collar 16' surrounds the rectangular frame 13' and is provided in engagement with the outer periphery thereof. The riser rings 20' are provided in rectangular shape to coincide with the shape of the frame 13'.

Figure 3:
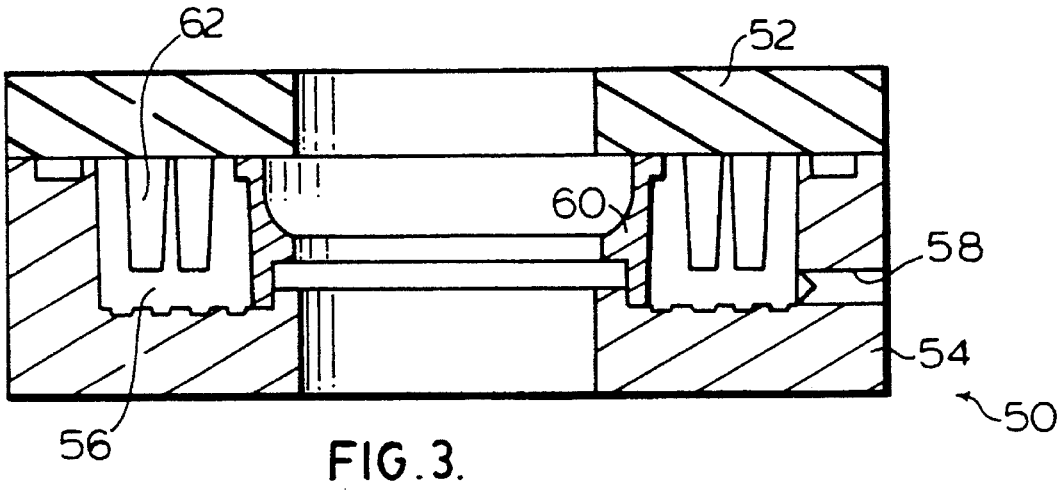
FIG. 3 is a sectional view of a mold structure employed to form transition collars according to one embodiment of the invention.
Figure 4:
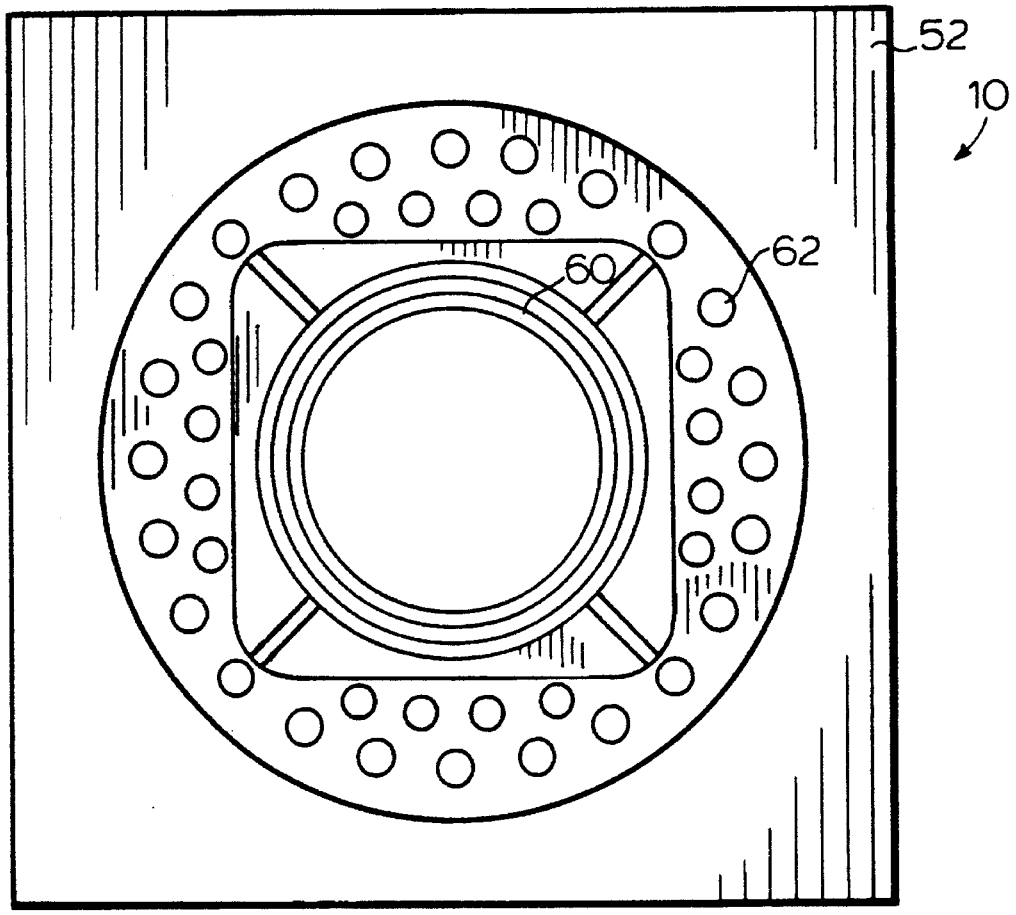
FIG. 4 is a plan view of the mold structure of FIG. 3.

Referring now to FIGS. 3 and 4, there is illustrated therein a mold structure 50 which is useful for forming the transition collars 16 by compression molding. As may be seen therein, the mold structure 50 comprises an upper mold element 52 and a lower mold element 54, which cooperate to define a mold cavity 56 in which the collars are molded. The mold cavity 56 is provided with an inlet 58 for feeding the granular rubber crumb from which the transition collar is molded.

The transition collar 16 is molded to the manhole frame structure 60 positioned in the mold 50 and providing the inner wall of the mold, so that an integral unit is provided for positioning in the roadway depression. The upper mold element 52 is provided with a series of studs 62 which project downwardly into the mold cavity 56. The studs 62 are arranged in a uniform array, as seen in FIG. 4. However, the number and size of such studs 62 is dependent on the mold and product design.

The studs 62 provide improved heat transfer to the transition collar 16 during the curing cycle, than in the absence of such studs, resulting in decreased curing time and an increased production rate of the collars.

SUMMARY OF DISCLOSURE

In summary of this disclosure, the present invention provides a novel resilient collar structure useful for providing an improved road structure, as described in detail above, as well as an improved mold structure to produce such collars. Modifications are possible within the scope of this invention.

What I claim is:

1. A roadway structure, comprising:

a subterranean access opening in a roadway, a self-supporting rigid frame structure surrounding said opening, a roadway pavement structure having a depression therein surrounding said subterranean opening and wherein is located said self-supporting rigid frame structure, a resilient transition collar structure received in said depression and surrounding said rigid frame structure and spacing the distance from said rigid frame structure to said roadway pavement structure, said roadway depression being dimensioned and said resilient collar structure being arranged such that the upper surface of the transition collar structure lies in substantially planar alignment with the upper surface of said roadway pavement structure, and one or more resiliently-flexible riser rings located in said depression in order to position the upper surface of said transition collar structure in substantially planar alignment with the upper surface of said roadway pavement structure.

2. The roadway structure of claim 1 wherein said resilient collar structure and/or said at least one resilient riser ring is formed from rubber scrap from automobile tires.

3. The roadway structure of claim 1 wherein said resilient collar structure is of circular outline with a central circular opening to snugly engage a cylindrical element of said rigid frame structure and said roadway structure has a circular depression formed therein adjacent said subterranean opening into which said resilient collar structure is received.

4. The roadway structure of claim 1 wherein said resilient collar structure is of square or rectangular outline with a square or rectangular opening therein snugly engaging a square or rectangular element of said rigid frame structure and said roadway structure has a rectangular depression formed therein adjacent said subterranean opening into which said resilient collar structure is received.

5. The roadway structure of claim 3 or 4 wherein said depression is dimensioned such that the upper surface of said transition collar structure lies in substantially planar alignment with the upper surface of said roadway pavement structure with the assistance of said at least one resilient riser ring.

6. The roadway structure of claim 1 wherein said the resilient collar structure is pre-molded to said rigid frame structure prior to positioning in the roadway depression.

7. The roadway structure of claim 1 wherein said resiliently-flexible riser rings comprise a set of three rings, two having a uniform thickness differing one from another and the other having a wedge-shape in side-elevation view, varying uniformly from a first thickness dimension at one side to a second thickness dimension at the other and members of such set are employed singly or multiply, as required, to effect said adjustment.

8. The roadway structure of claim 1 wherein said subterranean access opening is a manhole opening or a catch basin opening and said self-supporting rigid frame structure is constructed to support a rigid cover for the opening.

9. In a roadway construction, the combination of:

(a) a resiliently-flexible transition collar having a central opening formed therethrough for receiving a self-supporting rigid frame structure of a roadway subterranean access opening therein, and (b) a set of resiliently-flexible riser rings for adjusting the height and/or orientation of said transition collar in a roadway depression adjacent the subterranean access.

10. The combination of claim 9 wherein said resiliently flexible transition collar has a circular outline.

11. The combination of claim 9 wherein said resiliently flexible transition collar has a square or rectangular outline.

12. The combination of claim 9 wherein said set of risers includes first and second risers of different uniform thicknesses to effect height adjustment of said transition collar and a third riser of wedge shape in elevation, varying uniformly from a minimum dimension at one side thereof to a maximum dimension at the other side thereof to effect orientation adjustment of said transition collar.

13. The combination of claim 9 wherein said transition collar and set of riser rings are formed from scrap rubber from automobile tires.

14. The combination of claim 9 wherein the central opening in said transition collar snugly receives a self-supporting rigid frame structure therein.

15. A resiliently-flexible riser ring for use in a roadway construction comprising a self-supporting rigid frame structure and a resilient transition collar structure, said riser ring being formed from scrap rubber from automobile tires, said riser ring being one element of a set of resiliently-flexible riser rings comprising first and second risers of different uniform thickness to effect height adjustment of said transition collar structure in said roadway construction and a third riser of wedge shape in elevation, varying uniformity from a minimum dimension at one side thereof to a maximum dimension at the other side thereof to effect orientation adjustment of said transition collar.

* * * * *